United States Patent [19]

Barber

[11] 4,351,624

[45] Sep. 28, 1982

[54] FILE AND JACKET CONSTRUCTION METHOD AND APPARATUS

[76] Inventor: Ronald A. Barber, 519 S. Harrison St., West, Tex. 76691

[21] Appl. No.: 84,842

[22] Filed: Oct. 15, 1979

[51] Int. Cl.[3] ..... E02B 17/00; E02D 13/00

[52] U.S. Cl. ..... 405/228; 405/227; 405/251

[58] Field of Search ..... 405/224, 227, 228, 231, 405/232, 251

[56] References Cited

U.S. PATENT DOCUMENTS

| | | | |
|---|---|---|---|
| 711,013 | 10/1902 | Sooysmith | 405/232 |
| 3,213,629 | 10/1965 | Manning | 405/227 X |
| 3,672,177 | 6/1972 | Manning | 405/227 |
| 3,756,033 | 9/1973 | Kouka | 405/227 |
| 3,991,581 | 11/1976 | Kolb | 405/227 |
| 4,087,978 | 5/1978 | Landers | 405/227 |

*Primary Examiner*—David H. Corbin

*Attorney, Agent, or Firm*—Gunn, Lee & Jackson

[57] ABSTRACT

A method for setting piles at an offshore location is disclosed in the preferred and illustrated embodiment. A preferred apparatus is also disclosed. A pile formed of individual segments is placed inside a jacket at a location offshore. The first pile segment is supported by releasable hangers inside the jacket, and the two are floated together as a unit to the location. The jacket is aligned with the desired point on the bottom at a desired angle to enable pile driving to commence through the jacket. As the pile is driven into the bottom, additional sections of the pile are added to thereby increase its length. This enables the pile to be completed to any length and angle required for its construction.

9 Claims, 11 Drawing Figures

FILE AND JACKET CONSTRUCTION METHOD AND APPARATUS

BACKGROUND OF THE DISCLOSURE

In erecting an offshore platform, it is necessary to support a fixed platform with a number of legs. In one instance, the entire platform can be built on shore, complete with legs, towed to sea and thereafter positioned in an upright posture. A more popular method involves the procedure of positioning a pile jacket at a specified angle above the bottom and thereafter aligning a pile with the pile jacket. The pile is driven into the bottom by means of a pile driver. This method requires a barge to float the pile and jacket components to the site. It requires a separate barge equipped with a crane and a crane suspended pile driver. After the jacket is set in the ocean bottom, the barge supported crane is then maneuvered to lift a first segment of the pile which is threaded into the pile jacket. This is difficult because the pile jacket is ordinarily positioned at an angle with respect to the vertical. Moreover, the crane is supported by a barge which is moved by wave action. In view of the fact that the pile may weigh several tons and must be swung over at an angle to be snaked into the pile jacket, this procedure is difficult to implement. Indeed, occasions have occurred where hours have been required to thread the first pile segment into the pile jacket.

The apparatus of the present invention overcomes this severe problem. One feature of this invention is an apparatus comprised of a joined pile jacket and pile segment. They are joined together by means of connective links which can be selectively removed. They are joined together to travel as a unit with the pile segment received in the pile jacket. They are transferred by flotation or by barge. Moreover, the pile segment is located in the jacket from the beginning so that the most difficult step is avoided. This, therefore, enables the pile jacket to be positioned at an angle to guide the pile as it is erected on the ocean bottom without delay. Further, the releasable and connective links which join the two together are subsequently removed to enable the pile segment to be driven by a pile driver into the ocean bottom. Many pile segments can be joined together. In practical circumstances, it is not uncommon for a pile to be up to about 800.0 feet in length, typically with 400.0 feet of the pile driven into the ocean bottom and the remaining portions standing above the bottom to support a platform.

One advantage of this invention is the method of installation of a pile from segments on an ocean bottom. Another advantage of the method is the manner in which the pile segment and subsequently added segments are handled at the time of installation. The pile segment is secured by connective links on the interior of the pile jacket and at the end of the pile segment. Briefly, the connective links serve as anchors so that the two parts do not rattle or bang together during transit. Moreover, at the time of installation, they secure the pile segment at a location enabling an overhead crane to grab and manipulate the pile segment.

The connective links supporting the pile segment in the jacket include the feature of an elongate slot tolerating sliding movement. Sliding movement is tolerated so that the barge which supports the crane is free to bob up and down with wave action. Even though it may bob, it can still be used to handle the pile segment.

These features and many others are provided by the present invention which is summarized as a method and apparatus directed to a pile jacket and segmented pile arrangement. The apparatus utilizes an external pile jacket which surrounds a telescoped pile segment. The telescoped jacket and pile segment are thus handled as a unit from the time of manufacture until they are installed at an angle, typically by utilizing a derrick crane to set the pile jacket in the ocean bottom.

The procedure of the present invention thus contemplates the use of connective links to join the pile segments and pile jacket. The connective links are defeated when it becomes necessary to drive the pile segment into the ocean bottom. The pile segment is driven until it is substantially into the mud at which time it is necessary to attach other pile segments to extend the total length of the pile. The present apparatus includes connective links which assist in that also.

DETAILED DESCRIPTION OF THE PREFERRED EMBODIMENT

Figure 1:
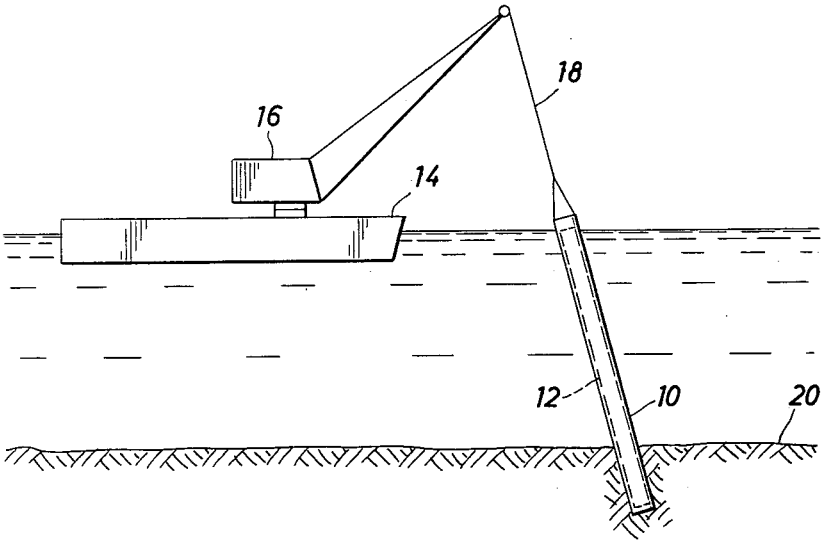
FIG. 1 shows the first step of a method of installing a pile jacket and pile therein utilizing the present invention.

Attention is first directed to FIG. 1 of the drawings for a description of some of the preliminary steps necessary to the erection of an offshore platform. Offshore platforms are utilized for navigation aids and in the offshore oil industry. As an example, an offshore platform may be erected to support oil well drilling equipment while a number of wells are drilled from the platform. After the drilling operation is over, the drilling equipment may be removed and replaced with completion equipment. The completion equipment is left on the platform while the producing wells continue to flow oil and gas. It will be appreciated that the platform must stand for many years.

Various techniques have been used heretofore to construct offshore platforms, and they are typically time and labor intensive. The method of the present invention, however, contemplates the use of an installation technique wherein a pile jacket 10 and an internally enclosed pile segment are handled as a unit from the shore location to the platform site. Specifically, the pile segment 12 is positioned within the pile jacket 10. They are tied together by connective links to be described. They are sealed over at the ends to define a buoyant body for flotation. The pile segment is shorter than the pile jacket 10 and is, therefore, received fully within it, and the two ends of the jacket are capped. More will be noted hereinafter regarding details of construction.

The pile jacket is transported by barge or flotation to the erection site. It is flooded as, for example, by opening flood valves or forming an opening in one of the caps to fill it with water and to sink the pile jacket. It is positioned at the desired location and held upright at the desired angle. The pile jacket 10 is driven into the mud bottom with the pile segment 12 on the interior. The driving step is ordinarily accomplished through the use of a barge supported pile driver. FIG. 1 thus illustrates a barge 14 having a crane 16 on it. The crane 16 supports the pile jacket 10 with an overhead cable 18. A pile driver (not shown) is used to set the pile jacket to the desired angle and depth in the ocean bottom 20.

Figure 2:
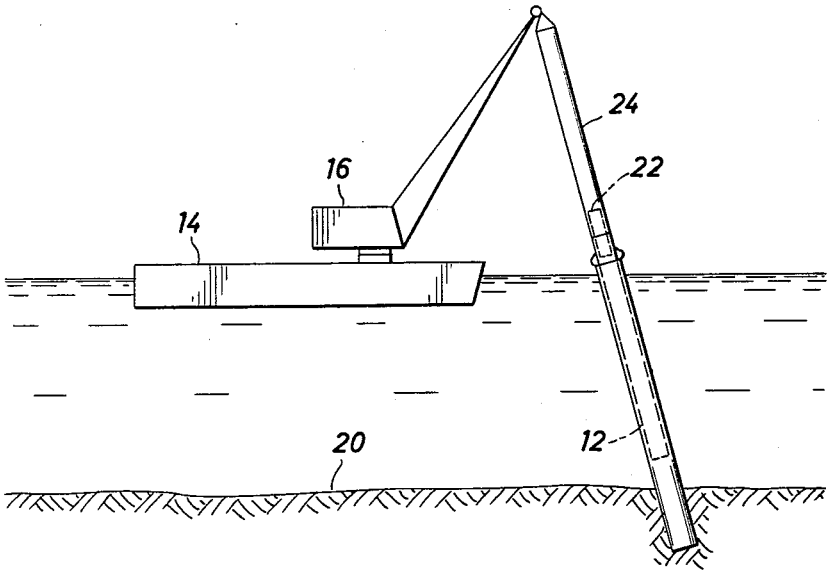
FIG. 2 shows the next step in the procedure in which a second pile segment has been joined to a first pile segment to be extended through the pile jacket.

FIG. 2 shows the next step in procedure. The pile jacket has now been driven into the bottom 20, and the pile segment 12 is then raised. After it is raised, a strongback 22 is positioned in the upper end of the pile segment 12. The pile segment 12, having been raised, is thus exposed so that the strongback 22 can be added to it. A second pile segment 24 is then attached to the first pile segment 12 utilizing the strongback 22 for alignment purposes. The two pile segments are joined by welding. For convenience, the strongback is first attached to the pile segment 24 at a shore facility. The attachment preliminary to shipment to sea expedites offshore work, reduces costs and speeds up pile erection.

Figure 3:
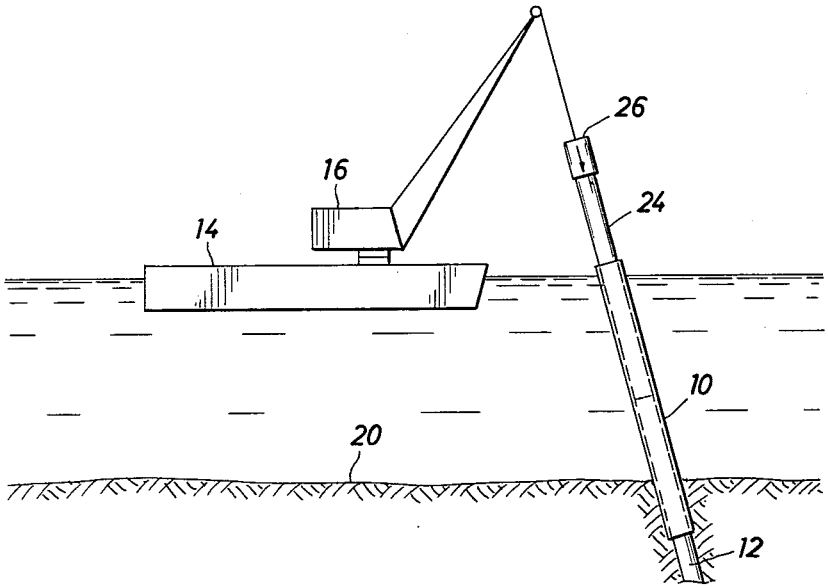
FIG. 3 shows additional steps wherein the several pile segments are driven by a pile driver through the pile jacket into the ocean bottom which continues the steps shown in FIGS. 1 and 2.

FIG. 3 shows the next step in extending the pile segments into the bottom 20. Again, the pile jacket 10 is shown at the same location. Ordinarily, it is not necessary to drive the pile jacket 10 deeper into the bottom 20. In FIG. 3, the pile segment 24 is driven deeper, and it is driven deeper by driving the lower pile segment 12 into the bottom 20. The pile segment 24 advances with the pile segment 12 because the two are attached together. A pile driver is schematically represented at 26.

The steps of extending the pile by adding additional segments as shown in FIGS. 2 and 3 are extended indefinitely. It is not uncommon to drive the pile hundreds of feet deep into the bottom 20. The pile might have a total length of 800.0 feet or so. In any event, it is assembled and extended indefinitely until the pile has reached the required length.

Figure 4:
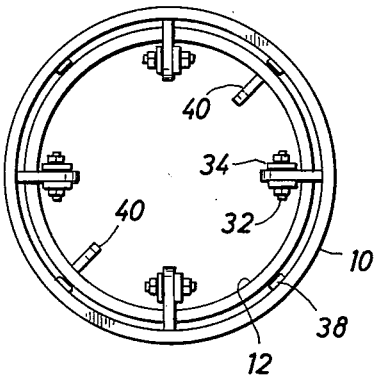
FIG. 4 is a top end view of the pile jacket and link connected pile segment therein which shows the connective links and eyelets for crane supporting the pile segments.
Figure 6:
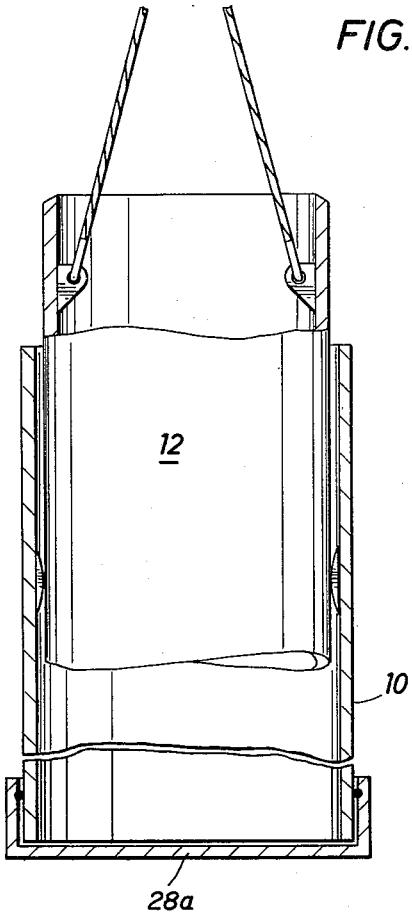
FIG. 6 is a view of the pile jacket and pile segment therein wherein the links have been removed and the eyelets are used to raise the pile segment.
Figure 5:
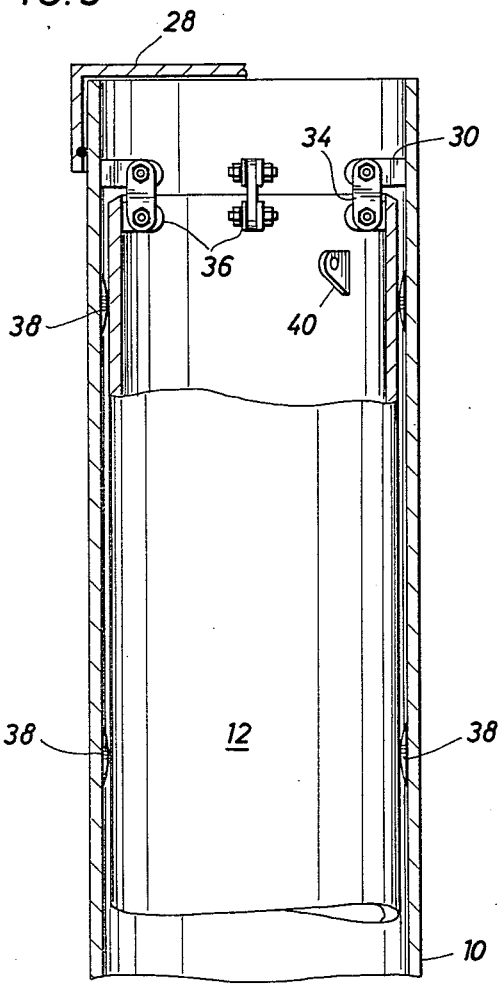
FIG. 5 is a longitudinal sectional view of the pile jacket and segment therein which are supported by links.

For a better understanding of the apparatus which is preferably used in the practice of the method of this disclosure, attention is directed to FIGS. 4 and 5, jointly. A removable cap 28 is shown in FIG. 5. It is removable when required. The cap 28 seals the interior to make the pile jacket watertight, there being a similar cap **28*a* at the lower end of the pile jacket as shown in FIG. 6. Through the use of a pair of caps, to close the upper and lower ends of the pile jacket the pile jacket can be made into a watertight compartment so that it can be floated to the point of installation, the cap removed and the jacket flooded to overcome its buoyancy. The pile jacket is handled thereafter in the manner described for setting the pile and pile jacket at the desired location. The cap 28 is temporarily affixed to the pile jacket 12** by any suitable means, usually a fully encircling weld. Ordinarily, it is made watertight by incorporating a seal on the interior adjacent to the jacket.

The pile jacket 12 supports an internally directed, fixed anchor eye 30. The anchor 30 has an end located eye. A bolt 32 is positioned through the eye. The bolt, in turn, connects with a pair of vertically deployed links 34. The links 34 are preferably used in pairs, one on each side of the anchor eye 30. The links 34 extend downwardly. The two links surround a similarly arranged, radially inwardly directed pad eye 36. The pad eye 36 is somewhat shorter than the longer anchor eye 30. This enables both of them to be aligned vertically so that the links 34 extend approximately vertically to interconnect the two eyes. The links 34 are held in position by suitable bolts and nuts. They are bolted at the top and bottom ends. The links 34 anchor the pile segment 10 to the pile jacket 12.

The pile jacket 12 supports the pile segment on the interior. As shown in FIG. 4, several connective link arrangements are included around the periphery of the pile jacket 12. The several are evenly spaced, there being four in the illustrated embodiment. The several links thus support the pile segment. In the upright position, the pile segment 12 is suspended inside the jacket 10 and is fully supported by the links at the upper end. The pile segment 10 is protected from bumping by a number of pads 38 at various elevations along the length of the pile jacket 10.

At the time of fabrication of the pile jacket and pile segment, they are joined together by the links which are shown in FIGS. 4 and 5. These links are subsequently removed. The originally fabricated pile segment also includes a set of internally directed eyelets 40. They are incorporated at spaced locations to receive and support the pile segment 12 on an overhead rope or line. The eyelets 40 are thus formed on the inside of the pile segment 12 so that they do not interfere with the remainder of the apparatus.

Attention is next directed to FIG. 6 of the drawings, where it will be observed that the links have been disconnected. The links and all their support equipment have been removed through the use of a cutting torch. Specifically, the internally protruding eyes 30 and 36 have been cut and removed. The weight of the pile segment 12 is then supported on the eyelets 40 by means of overhead lines. Suitable hooks and lines are used to hoist the pile segment into the air, and it is raised above the top end of the pile jacket 10. In the elevated position, workmen find access to the exterior for attaching externally located registration lugs 42. The lugs 42 are constructed with an external shoulder which abuts the top end of the pile jacket. The lugs 42 are welded in place, and, preferably, three or four are placed around the periphery. The three or four are welded in position. Moreover, the three or four lugs are registered, thereby evenly distributing the weight of the pile segment 12 on the top end of the pile jacket 10. The weight is supported with the top end exposed so that additional construction can occur at the top end of the pile segment 12. This construction is illustrated in FIG. 8 of the drawings.

In some instances, it is convenient to simply cut off the end portion of the pile segment or jacket. In contrast with the procedure of cutting protruding eyes from the interior where access might be limited, greater speed and convenience can be achieved by cutting off the end portion (perhaps 1.0 meter or less) of the segment of a pile or surrounding jacket. The cut line is just below the protruding eyes.

Figure 8:
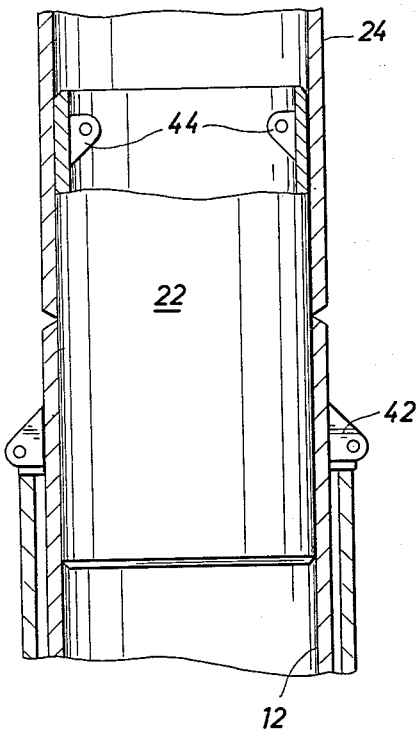
FIG. 8 is a sectional view similar to FIGS. 6 and 7 which shows the pile segment supporting an internal strongback aligned with an additional pile segment.

Continuing with a description of the method in which the pile is assembled from several pile segments, the lower pile segment 12 is shown in FIG. 8 supported on the external lugs 42. A strongback 22 is located in the top end of the pile segment 12. The pile segment 24 is attached above the strongback 22 which is welded to the top end of the pile segment 12. The strongback is hoisted into location by internally located eyelets 44. The eyelets 44 enable the overhead crane to support the strongback in location until it is welded to the segment 12. As mentioned earlier, the strongback can be conveniently attached to the top pile segment as a preliminary step.

The strongback 22 extends above the top end of the pile segment 12. It telescopes into the next pile segment and is also welded to it. For ease of telescoping, the strongback can be constructed with a transverse, right cylindrical end as shown in FIG. 8, or it can be constructed with a spade tip as will be obtained by truncating the strongback. In either case, the strongback telescopes in the upper pile segment 24 and is welded to it. When the weld is completed, the two pile segments then form a single pile and function together as a unit.

Figure 11:
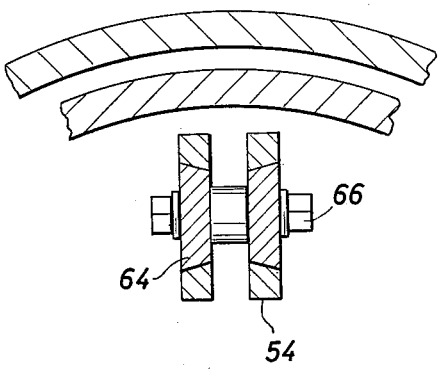
FIG. 11 is a sectional view along the line 11—11 of FIG. 10 showing details of construction of the slot in the connective links.
Figure 9:
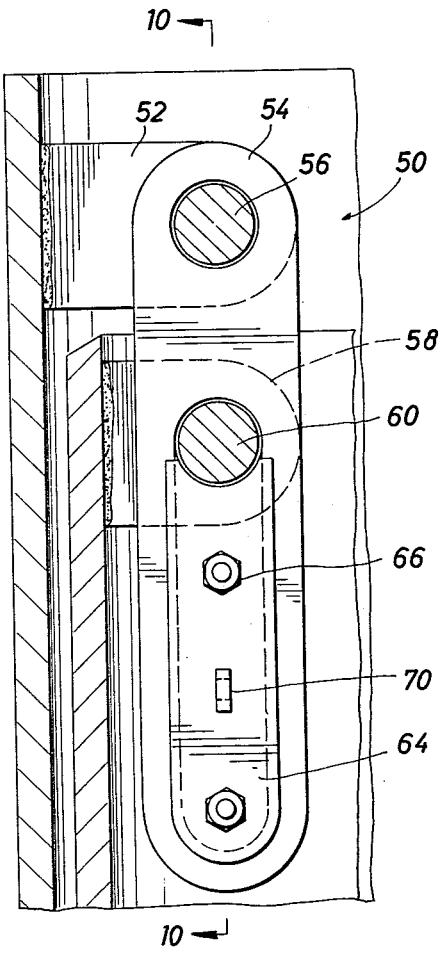
FIG. 9 is an enlarged, detailed view of connective links between the pile jacket and pile segment which support them for movement as a unit.
Figure 10:
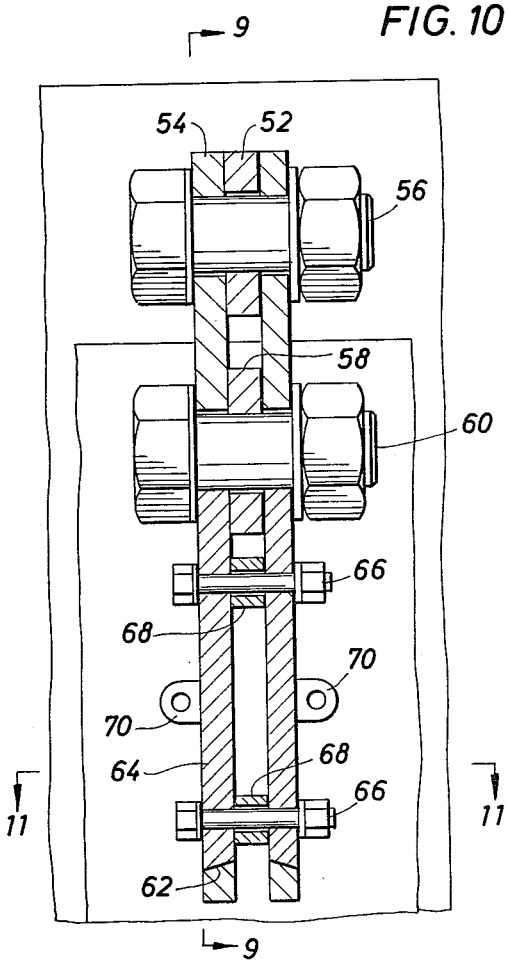
FIG. 10 is an orthagonal view to the structure of FIG. 9 partly in section at the connective links showing an elongate slot which accommodates sliding movement between the pile segment and pile jacket.

FIGS. 9, 10 and 11, considered jointly, disclose an alternate link system identified generally by the numeral 50. The link system 50 accommodates telescoping movement as the barge supporting the crane rises and falls with wave action. As viewed in FIGS. 9 and 10, considered jointly, the numeral 52 identifies a welded, fixed eyelet which protrudes radially inwardly and which is penetrated by a bolt hole. The eyelet 52 is bracketed by a pair of connective links 54 which are substantially identical. The links 54 are provided with bolt holes at the upper end to receive a suitable nut and bolt with lock washer at 56. The bolt is tightened to secure the links 54 in position.

The eyelet 52 is attached to the pile jacket. A similar, but shorter, eyelet 58 is attached to the pile segment telescoped on the interior of the pile jacket. The eyelet 58 is perforated with a bolt hole, and a suitable bolt, nut and lock washer assembly at 60 fastens through the eyelet 58. As shown in FIGS. 9 and 10, the links 54 limit vertical movement because the bolts 56 and 60 secure the pair of links to the fixed eyelets.

As shown in the side view of FIG. 9, the links 54 have a single opening at the top end for the bolt 56. The links 54, however, incorporate lengthwise slots better shown in FIG. 9. The bolt 60 is fastened through the links at the top end of the slots which are temporarily plugged. The lengthwise slot is thus identified by the numeral 62 and is cut so that it is conic in section as shown in the drawings. A plug 64 is positioned in the slot. The plug, while being substantially elongate in one dimension, is, nevertheless, on transverse cross section, shaped in a trapezoid section so that it can be inserted from one side and lifted out from that one side. The plug 64 cannot pass through the slot. Rather, the plug 64 wedges into the lengthwise slot to fill the slot and to leave only a circular opening at one end. The slot 64 is thus constructed with a tapered sidewall to receive the plug 64 between the parallel tapering sides and at one end. At the opposite end where the bolt 60 is located, the slot has a right cylindrical, semicircular end wall.

The plug 64 which fills the slot is held in position by a suitable bolt 66. The bolt 66 is threaded to a nut, the nut and the head of the bolt clamping the plug 64 in position. The present apparatus is preferably used with a pair of links which are substantially identical, the two links being plugged in a substantially identical manner with similar plugs. The two plugs 64 face outwardly so that they can be retrieved by movement away from the links. The two links are pulled toward one another and into a locking relationship by the bolt 66. A spacer washer 68 is positioned between the two plugs to hold the two plugs at a spaced distance.

In the preferred embodiment, the plugs 64 are fairly long, and they are, therefore, held together at two or more locations by identical bolts 66, the bolts being fastened through the plugs and passing through spacer washers 68. Each plug includes a protruding ear or tab 70 to enable the plugs to be grabbed and retrieved.

The length of the slot 62 depends on the violence of the wave action. If the wave action is vigorous, it might be necessary to utilize a slot which is as much as 2.0 feet long. This defines a significant range of excursion. The slots come into play at the time of transition when the pile segment 12 is supported by the links shown in FIG. 5 to the movable telescoped position of FIG. 6, where the overhead cables support the pile segment 12. This transition stage thus occurs in the following manner. The pile jacket 10, in a more or less upright position, supports the pile 12 on the interior. The beginning condition ordinarily occurs with the links fixed and the plugs 64 in the link slots so that telescoping movement is not possible. The overhead crane is deployed, and the cable 18 is dropped into the pile segment 12, and it is loosely hooked to the protruding eyelets 40 shown in FIG. 4. Some of the slack in the overhead cable is retracted, but the cable is not made taut. The plug bolts 66 shown in FIG. 10 are removed, and the slot plugs 64 first in one link and then another are removed. It should be recalled that three or four sets of links are spaced around the piling 12. As they are removed, the load then shifts to the last remaining links. The weight is not taken by the derrick crane until all links are removed and the rigging team is outside the pile. The cable 18 is then tightened so that the entire weight of the pile segment 12 is supported on the overhead cable. When this has occurred, the cable can then be slacked so that the pile segment 12 moves downwardly in FIGS. 9 and 10 with the bolt 60 traversing the full length of the slot 62. Full travel is not necessarily required, but it is made available to accommodate rising and falling of the crane on the waves.

The range of movement is thus determined by the length of the slots 62. This is a scale factor which can be varied accordingly.

The links including eyelets shown in FIGS. 9 and 10 can be removed, for instance, by use of a cutting torch in the same manner as the links shown in FIG. 5 or by cutting a top section of the pile leg in which case all the rigging will come off with that portion of the pile.

From the foregoing, practice of the method of the present apparatus will be understood and made more readily apparent from a review of the apparatus and relying on the drawings which are attached hereto.

The method of the present invention thus incorporates the beginning step of transporting the pile jacket from a distribution point to an offshore location. It is transported with the segment 12 on the inside, supported by hangers and aligned by the cushions or pads 38. Both ends are capped, and the caps are opened only at a convenient time. The caps may include valves. Properly placed valves will then be opened and flood the previously buoyant jacket and cause the jacket to sink. When it sinks, it is aligned in the manner illustrated in FIG. 1. Alignment is assisted by crane support and cable from barge mounted winches. It is also driven at the requisite angle and location through the use of a pile driver to fasten the pile jacket at the bottom 20. It is driven to an adequate depth to thereby enable the pile jacket to function as a guide. The pile may be extended later. That is not important to its enhanced function as depicted in FIGS. 1, 2 and 3 as a guide for fabrication and installation of the piling.

The pile is driven into the mud at the bottom and punctures through the bottom 20 to a requisite depth. The pile is extended through the use of the strongback 22 shown in FIG. 2. Different segments are added as the pile penetrates the bottom 20, and the additional segments are joined serially to obtain the required length for the piling.

Figure 7:
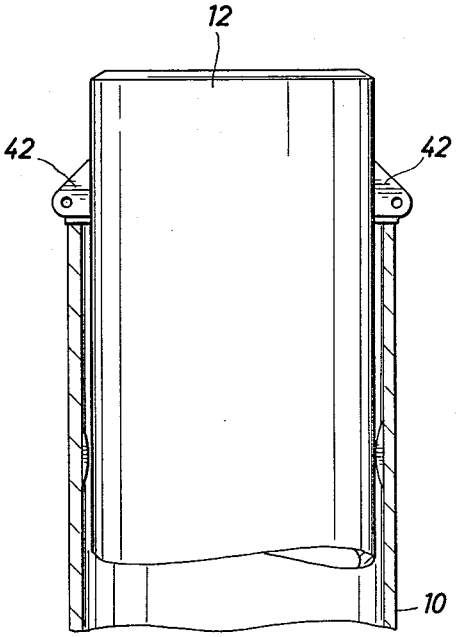
FIG. 7 is a view similar to FIG. 6 showing external lugs added to the pile segment to position the pile segment at a specified elevation relative to the pile jacket.

The actual procedure is better understood on referring to the drawings which show the method of connection between the upper end of the jacket and pile segment within the jacket. Reference is made to FIG. 5 of the drawings. The links which are shown there selectively maintain connection. In particular, they are disconnected while supporting the weight of the segment 12 with an overhead crane as shown in FIG. 6. The links are not only disconnected, but they are additionally removed. They are removed so that the means 30 does not obstruct the path for the segment 12 as it is raised. The means 36 are likewise removed so they do not obstruct the interior of the pile segment to permit the insertion of a strongback. A strongback is attached after supporting the piling 12 on the externally located, protruding ears. This is shown in FIG. 7, the ears 42 holding the segment 12 at an elevated position above the top end of the pile jacket for easy access. This permits workmen to have access to the area to weld the strongback 22 in position as shown in FIG. 8 and to thereafter position the next pile segment on top of it and to weld the segment 24 in position.

The method of attachment shown in FIG. 5 can be modified through the use of the slip links shown in FIGS. 9 and 10. They provide more flexibility so that the apparatus is able to ride up and down with wave action which is imparted to the pile segment by the crane on the barge.

The foregoing reduces the time of on-site installation of the pile jacket and pile within the jacket. Moreover, it is much safer to use. This inevitably reduces costs and enables greater use of constructed offshore platforms.

The foregoing is directed to the preferred embodiment, but the scope is determined by the claims which follow.

I claim:

1. A method of constructing a pile extending through the bottom of a body of water which comprises the steps of:

(a) positioning a pile jacket at a desired location and angle relative to the bottom of a body of water and driving the pile jacket into the bottom to a specified depth;

(b) temporarily storing within the pile jacket a first pile segment preliminary to the step of positioning the pile jacket said temporary storage being accomplished by connector link means releasably secured to internal eyelet means of both said pile segment and pile jacket;

(c) releasing said connector link means from said eyelet means after driving said pile jacket;

(d) removing said internal eyelet means of said pile jacket;

(e) raising the pile segment to expose one end thereof protruding from said pile jacket;

(f) joining a second pile segment serially to said pile segment by welding, a strongback being positioned within the adjacent extremities of said first and second pile segments prior to said welding, said strongback aligning said pile segments;

(g) driving the first pile segment and second pile segment into the bottom through said pile jacket; and (h) alternately adding additional pile segments to the pile segment aligned and positioned within the pile jacket and driving the pile segments serially through the pile jacket into the bottom and continuing such alternation until the several pile segments form a pile having a specified length and extending through the bottom to a specified depth.

2. The method of claim 1 including the further step of initially positioning a pile segment within the pile jacket and closing over the ends of the pile jacket to define a flotable pile jacket which is thereafter transported to the locale at which the pile is to be erected, then flooding the pile jacket and positioning the pile jacket at the desired angle and position at the desired location prior to setting the pile jacket in the bottom.

3. An apparatus for use in construction of bottom supported structures in a body of water which comprises:

(a) an elongate, axially hollow, tubular pile jacket having first and second ends and an elongate, axially hollow passage therein;

(b) a pile segment having the form of an elongate tubular member with first and second ends which is constructed and arranged to fit within the axial passage of said pile jacket, said pile segment being captured within said pile jacket; and (c) internal connector eyelet means being secured internally of said pile jacket;

(d) internal connector eyelet means being secured internally of said pile segment; and (e) removable connective link means temporarily joining said internal connector eyelet means of said pile segment and jacket and securing said pile segment and pile jacket in unitary assembly.

4. The apparatus of claim 3 wherein said pile jacket and pile segment each are formed of elongate, hollow, tubular members concentrically positioned relative to one another and including removable cap means closing over both ends of said pile jacket wherein said pile segment is shorter than said pile jacket and is enclosed within said pile jacket and between said cap means.

5. The apparatus of claim 3, wherein said connector link means includes:

elongated slot means being defined in said connector link means and allowing relative movement of said pile segment and pile jacket; and means for selectively closing said elongated slot means to prevent relative movement of said pile segment and pile jacket.

6. A method of constructing a pile extending through the bottom of a body of water which comprises the steps of:

(a) providing a pile jacket having internally protruding eyelet means;

(b) positioning a pile segment within said pile jacket, said pile segment having internally protruding eyelet means;

(c) securing connecting links to said internally protruding eyelet means of said pile jacket and pile segment to thus secure said pile segment within said pile jacket;

(d) positioning said pile jacket at a desired location and angle relative to the bottom of said body of water;

(e) attaching hoisting means to said internal eyelet meens of said pile segment;

(f) releasing the links connecting the pile segment to said pile jacket;

(g) hoisting the pile segment sufficiently above the pile jacket to enable a means to be applied externally to the pile segment to hold said pile segment partially exposed above said pile jacket;

(h) welding a second pile segment to the top exposed end of said first pile segment;

(i) removing said hoisting means from said internally protruding eyelet means of said pile segement;

(j) thereafter axially moving the two joined pile segments downward as a unit through said pile jacket; and (k) alternately adding additional pile segments to the pile segment aligned and positioned within said pile jacket and driving the pile segments serially through the pile jacket into the bottom and continuing such alternation until the several pile segments form a pile having specified length and extending through the bottom to a specified depth.

7. The method of claim 6 wherein the joined pile segments are driven as a unit into the bottom through the pile jacket and thereafter adding a third pile segment serially to the first and second pile segments by welding one end thereof to the second pile segment.

8. The method of claim 6 wherein said first and second pile segments are welded together by first placing therebetween a strongback internally positioned within the first and second pile segments wherein the strongback aligns the first and second pile segments relative to one another.

9. The method of claim 8 wherein the strongback is welded in position.

* * * * *